United States Patent [19]

Huni et al.

[11] Patent Number: 4,505,796

[45] Date of Patent: Mar. 19, 1985

[54] ELECTROLYTIC REDUCTION CELLS

[75] Inventors: Jean-Paul R. Huni; Ethan A. Hollingshead; Thomas G. Edgeworth; Raman R. Sood; Ernest W. Dewing, all of Kingston, Canada; Charles J. Rogers, Whitebridge, Australia

[73] Assignee: Alcan International Limited, Montreal, Canada

[21] Appl. No.: 391,406

[22] Filed: Jun. 23, 1982

[30] Foreign Application Priority Data

Jun. 25, 1981 [GB] United Kingdom ..... 8119590

[51] Int. Cl.[3] ..... C25C 3/00; C25C 3/06

[52] U.S. Cl. ..... 204/243 R; 204/243 M; 204/250; 204/67

[58] Field of Search ..... 204/243 R, 245, 243 M, 204/67, 244, 246, 247

[56] References Cited

U.S. PATENT DOCUMENTS 3,093,570 6/1963 Dewey ..... 204/243
4,308,114 12/1981 Das et al. ..... 204/67
4,326,939 4/1982 Schmidt-Hatting ..... 204/243 M
4,338,177 7/1982 Withers et al. ..... 204/245
4,436,598 3/1984 Tabereaux et al. ..... 204/67

FOREIGN PATENT DOCUMENTS 1389243 4/1975 United Kingdom .

*Primary Examiner*—Brian E. Hearn
*Assistant Examiner*—Stephen J. Kalafut
*Attorney, Agent, or Firm*—Cooper, Dunham, Clark, Griffin & Moran

[57] ABSTRACT

An electrolytic reduction cell for the production of molten metal by electrolysis of a molten electrolyte, which is less dense than the molten metal includes a generally rectangular shell, one or more suspended anodes and a floor structure which supports a body of the molten metal. At least one essentially linear baffle member extends transversely of the cell and is formed with restricted flow channels for absorbing energy from the molten metal and to reduce the amplitude of the wave motion in the molten metal. The baffle may be in the form of a single member formed with apertures for metal flow restriction or may be constituted by a number of separate aligned members with metal flow channels between them.

5 Claims, 6 Drawing Figures

ELECTROLYTIC REDUCTION CELLS

The present invention relates to electrolytic reduction cells for the production of metal by the electrolysis of a metal-bearing substance in a molten electrolyte, which is less dense than the product metal.

The production of aluminium by electrolysis of alumina in a fused fluoride electrolyte is one example of such a process.

A typical electrolytic reduction cell for the production of aluminium is rectangular in shape. The cell includes one or more suspended anodes and a cathode structure, comprising carbon blocks, forming the floor of the cell, in electrical connection with transverse steel current collector rods or bars which are connected to cathode bus bars extending lengthwise of the cell.

In such cells a pool of the molten product metal collects on the floor of the cell and forms a liquid cathode, from which a batch of molten metal is withdrawn at intervals. Because the molten aluminium layer is more conductive than the carbon floor blocks, transverse components of the cathode current occur in the molten metal layer and these interact with the electromagnetic fields in the cell, resulting from the very heavy currents in the electrical conductors associated with the process. The electromagnetic forces result in the establishment of wave motion in the molten metal. Wave motion may also be induced in the molten metal by the evolution of gas bubbles.

In conventional electrolytic reduction cells it is necessary to maintan the anode(s) at a substantial distance from the datum position of the surface of the molten metal to avoid intermittent shorting between the crests of the waves in the molten metal and the undersurface of the anode(s).

It is an object of the present invention to reduce the amplitude of the wave motion in the molten metal in the cell.

It has already been proposed in U.S. Pat. No. 3,093,570 to employ cylindrical cathode collector members projecting into the molten metal in conjunction with a non-carbonaceous cell lining and these members are said to be employed to control the circulation of the metal. However such collector members would constitute a relatively inefficient means of controlling the metal flow and humping of the metal in the large electrolytic cells of 140 kA and upwards. With such cells the magnetic fields associated with the bus bars are greatly increased in intensity and the magnetohydrodynamic forces acting on the metal pool are increased more than linearly in relation to cells of smaller capacity.

In contrast with the construction referred to above an electrolytic reduction cell in accordance with the present invention is provided with at least one essentially linear transversely extending baffle member in which energy absorbing restricted flow channels are formed. Such flow channels may be provided between aligned spaced elements which together constitute a single baffle member or may be in the form of apertures in a unitary baffle member.

The baffle member or members are essentially in the form of long, low massive members, which are stronger and more resistant to accidental damage than the unsupported collector bars of U.S. Pat. No. 3,093,570.

Such baffle members extend upward from the floor by only a small amount and the height of such members is preferably such that they remain wholly submerged in the molten metal at all stages of the normal cell operating cycle. In such event it would be sufficient for such members to be constructed from carbon or alumina or other refractory material resistant to attack by molten aluminium. Where there is a risk that the baffle members may be partially exposed to the molten electrolyte during the cell operation, they should be constructed from a material which is resistant to attack by the molten electrolyte, as well as to attack by the moltem aluminium metal. Because accidental contact between the baffle members and the molten electrolyte must always be regarded as a possibility, it is preferred that the baffle members be constructed of a refractory material resistant to attack by electrolyte, as well as resistant to molten aluminium. The baffle members must either be formed of a material more dense than the product metal or be attached to the cell structure. A titanium boride refractory is one example of a material found very suitable for the present purpose because of its resistance to attack by both molten aluminium and the molten electrolyte. Because titanium boride is electroconductive it causes little disturbance of the current pattern in the pool of molten metal and this may be advantageous in some instances.

In operation the baffle members exert a damping effect on flowing molten metal to absorb its kinetic energy and thus reduce the amplitude of its wave motion.

It may be preferred that, in conjunction with the metal flow-restricting baffle members, the cell is provided with means for maintaining the volume of molten metal in the cell at a substantially constant value. For that purpose the cell may be provided with one or more selective filters, operative to permit passage of molten metal and to restrict passage of molten electrolyte, as described in co-pending British Patent Application No. 8119589. Such selective filter(s) is/are arranged to allow molten metal to be withdrawn from the pool of molten metal on a continuous basis.

One problem arising in the operation of an electrolytic reduction cell is the formation of sludge in the bottom of the cell beneath the molten metal pool. Such sludge is composed, at least in substantial part, of alumina feed material which has failed to dissolve in the cell electrolyte and has passed into and through the molten metal, since alumina is more dense than molten aluminium and drags molten electrolyte into the bottom of the cell.

Since sludge conducts electricity relatively poorly it would adversely affect the passage of current to cathodic floor blocks (where such are employed in the construction of the cell) if it formed a continuous layer over the whole of the floor of the cell. In a conventional cell, however, the sludge slowly migrates to the sides of the cell and is apparently slowly readsorbed into the electrolyte via the surface of the frozen electrolyte, which is present at the walls of the cell. Thus the cell is preferably constructed so that sludge may migrate to the sides and/or ends of the cell to permit such reabsorption to take place.

The baffle members are arranged transversely of the cell and located so as to extend outwardly of and/or somewhat inwardly of the edges of the anode shadow area at positions where (in the absence of the baffle members) the metal flow velocity is at its maximum. The baffle members are preferably arranged substantially perpendicular to the direction of metal flow.

Since the purpose of the baffle members is to establish tranquil, relatively wave-free conditions in the molten metal, each baffle member is associated with energy-absorbing devices, such as restricted apertures extending along the direction of the metal flow to exert a damping action on such flow. Each baffle member should have a large thickness to height ratio (height being the vertical extent of the baffle member above the floor of the cell, although a substantial part of the baffle member may be embedded in the floor of the cell). The thickness/height ratio is preferably at least 1/1. The baffle members may be formed with circular apertures in a size range of 5–50 mm. and occupying 10–50% of the effective surface of each baffle member. Alternatively the baffle members may be made from a thick honeycomb material having triangular, square or other-shaped apertures of sizes in the above stated range and occupying up to 70% of the surface area of the honeycomb. As a further alternative each baffle member may be formed of a series of separate blocks arranged in side-by-side relation to present relatively narrow flow-restricting channels between adjacent blocks to perform the same function as the aforesaid apertures.

For constructional convenience such blocks may be simple rectangular blocks but may take other forms better adapted to absorb the kinetic energy of the molten metal under the particular conditions of the cell. Thus the blocks may be trapezoidal in profile. Similarly the faces of the blocks presented to the flowing metal may be inclined forwardly or backwardly in relation to the vertical.

If it is found desirable to include longitudinal baffle members in addition to transverse baffle members, for wave-damping purposes in the anode shadow area, it is desirable that such longitudinal baffle members should be mounted in such a manner as to permit an unobstructed lateral flow of sludge beneath each longitudinal baffle member to the side areas of the cell for the reasons explained above. This may conveniently be achieved by supporting such longitudinal baffle members on the transverse baffle members with the bottom edge surface of the longitudinal baffle members slightly raised above the floor of the cell.

Where the cell employs two parallel rows of anodes and feed alumina is supplied to the cell by breaking the crust between the anode rows, it is preferable to provide a pair of spaced solid longitudinal baffle members adjacent the inner margins of the anode shadow area of the two rows of anodes and mounted in the floor of the cell to prevent lateral spread of sludge from the central area into areas in the anode shadow of the respective anode rows.

Referring now to the accompanying drawings.

Figure 1:
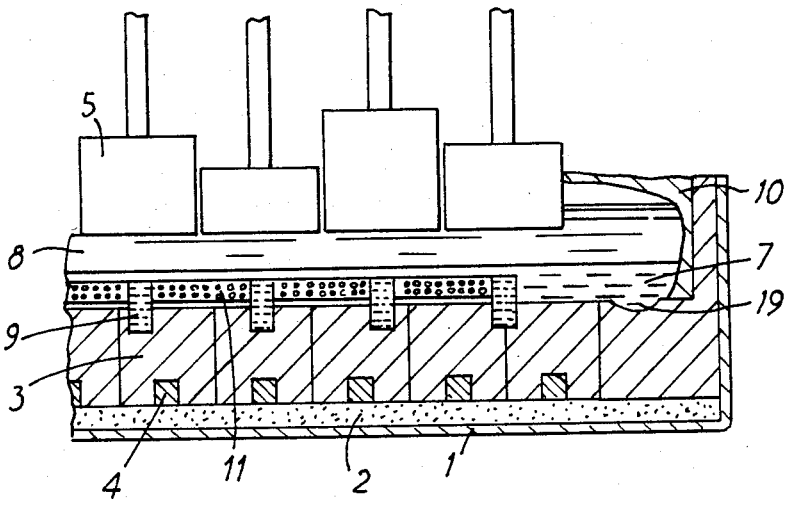
FIG. 1 is a partial diagrammatic longitudinal section of one form of electrolytic reduction cell in accordance with the invention.
Figure 2:
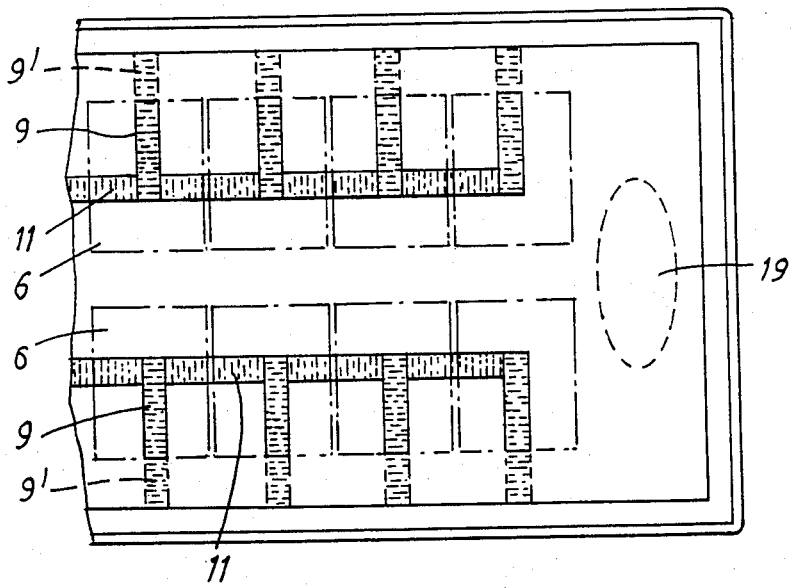
FIG. 2 is a partial horizontal section of the cell of FIG. 1.

In FIGS. 1 and 2 the cell comprises a rectangular steel shell 1, lined with electrical and thermal insulation 2. The cell is provided with a conventional cathode floor structure formed of carbon blocks 3, electrically connected to steel collector bars 4 which carry the cathode current to bus bars (not shown) extending along the two longitudinal sides of the cell in the well known manner. The cell is provided with parallel rows of prebake anodes 5, the shadow areas of which are indicated at 6 in FIG. 2. In operation there is a pool of molten metal 7 in the bottom of the cell and and overlying layer of molten fluoride electrolyte 8.

Transverse baffle members 9 are recessed into the carbon floor blocks 3 at positions within the anode shadow areas and these baffle members may have portions 9' extending outwardly into the frozen electrolyte 10 at the sides of the cell (not shown in FIG. 2).

The transverse baffle members 9 may support longitudinal baffle members 11 with lower edges of such longitudinal baffle members spaced slightly away from the floor to permit sludge to move transversely beneath.

Figure 4:
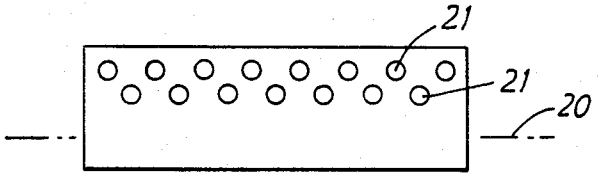
FIGS. 4, 5 and 6 show three possible alternative constructions of baffle members for the cells of FIGS. 1, 2 and 3.
Figure 5:
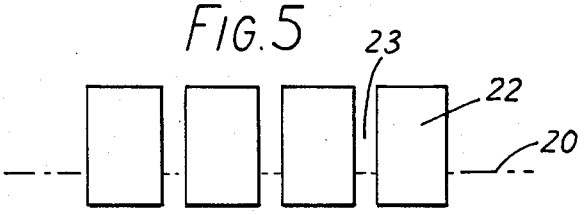
Figure 6:
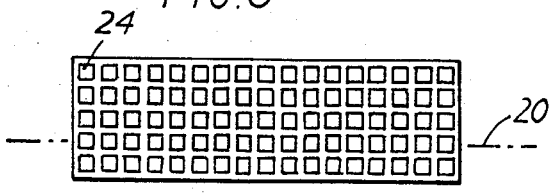

In FIGS. 1 and 2 the baffle members 9 may take any of the forms indicated in FIGS. 4, 5 and 6.

In FIGS. 4, 5, 6, the transverse dotted line 20 indicates the top surface of the cell floor 3. The part of the baffle member beneath the dotted line is intended to be embedded in the cell floor.

In FIG. 4 a baffle member having an overall height of 10–15 cms, is formed with two rows of apertures 21, having a diameter of about 3 cms. the apertures forming about 20% of the exposed area of the baffle member.

In FIG. 5 the baffle member is formed of separate rectangular blocks 22 having a width of about 10–15 cms. and spaced apart by a distance of 2–3 cms. to provide energy-absorbing flow channels 23.

In FIG. 6 the baffle members are comprised of a honeycomb section in which apertures 24 are squares of 1–2 cms. width and form about 70% of the frontal area of the baffle member.

In each case the thickness of the baffle members is of the order of 10–15 cms. or more to provide desirable strength.

Longitudinal baffle members 11 may take the same general form as those shown in FIGS. 4, 5 or 6. When in the form of FIG. 4 or FIG. 6 the height of the baffle member 11 will be reduced so as to permit transverse flow beneath it while retaining the top edge at substantially the same level as the top edge of the baffle members 9, whereas when the baffle member 11 takes the form of that shown in FIG. 5, the separate blocks are mounted in the floor and the channels 23 permit transverse sludge transport.

Figure 3:
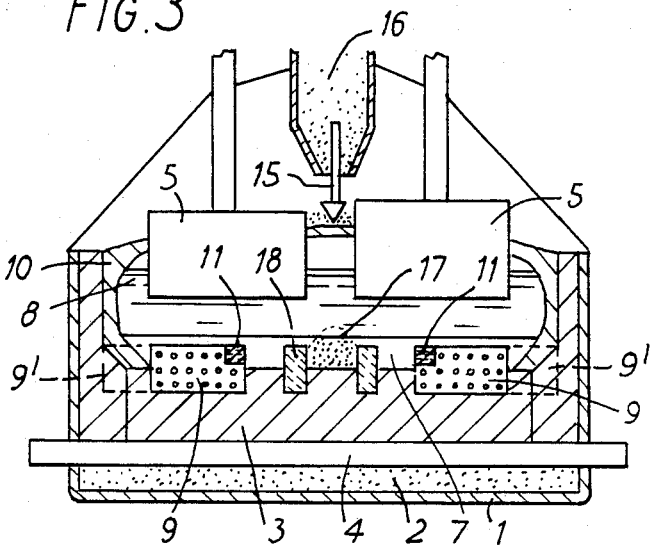
FIG. 3 is a partial vertical section of a cell equipped for central crust breaking and feeding.

In the construction of FIG. 3 like references are employed to indicate the same parts as in FIGS. 1 and 2. In this construction a crust-breaker 15 is provided between the two spaced rows of anodes 5 to allow the feeding of alumina direct to the electrolyte 8 from a hopper 16.

With this type of arrangement there is some tendency to form sludge at the location 17, directly beneath the alumina feed device constituted by crust-breaker 15 and feed hopper 16. This sludge is desirably confined in the central area between solid, unapertured longitudinal baffle members 18, which may be formed of electrically conductive or non-conductive material.

In both the constructions of FIG. 1 and of FIG. 3 it is preferred to provide a shallow depression 19 at one end of the cell as a draw-off point for syphon-tapping of the cell in a conventional manner. As an alternative, the quantity of molten metal in the cell may be maintained substantially constant by the employment of the already mentioned selective filter described in co-pending British Patent Application No. 8119589 to which corresponds United States patent application Ser. No.

391,410, filed June 23, 1982, by Adam Jan Gesing et al., and assigned to the same assignee as the present application.

In operation of the cell it is found that the arrangement of baffle members results in a substantial reduction in the amplitude of the wave motion in the metal pool and increased stability at the interface between the molten metal 7 and the electrolyte 8.

As a result of the increased stability of the metal/electrolyte interface it is found practicable to maintain the anodes at a smaller spacing from the datum position of such interface with consequent improvement in the efficiency of the process. With reduction in the distance between the anode and the liquid metal cathode the cell resistance may be very substantially reduced, possibly up to 20%. This improves the energy efficieny of the process and may increase the productivity of the cell.

It will be understood that the baffle members 9 and 11 are formed from material which is resistant to attack by molten aluminium metal and preferably have at least an external skin of a refractory hard metal such as titanium diboride so as to render them resistant to attack by the cell electrolyte. Such baffle members may be electroconductive or substantially non-conductive.

We claim:

1. In an electrolytic reduction cell for the production of molten metal by electrolysis of a molten electrolyte, which is less dense than the product metal, said cell comprising one or more anodes suspended above a floor structure, on which is located a body of molten product metal constituting the cathode of the cell, and a generally rectangular shell having side and end walls for containing the molten contents of the cell, the improvement which consists in at least one essentially linear baffle member extending transversely of the cell and having energy-absorbing restricted flow channels formed therein, said baffle member extending upwardly from the cell floor to a position close to the level of molten metal in the cell, the flow channels of said baffle member comprising a series of flow restricting apertures formed in said baffle member.

2. In an electrolytic reduction cell for the production of molten metal by electrolysis of a molten electrolyte, which is less dense than the product metal, said cell comprising one or more anodes suspended above a floor structure, on which is located a body of molten product metal constituting the cathode of the cell, and a generally rectangular shell having side and end walls for containing the molten contents of the cell, the improvement which consists in a plurality of essentially linear baffle members each extending transversely of the cell and having energy-absorbing restricted flow channels formed therein, said transverse baffle members extending upwardly from the cell floor to a position close to the level of molten metal in the cell and being longitudinally spaced, said transverse baffle members supporting at least one longitudinally extending baffle member, said longitudinally extending baffle member having its lower edge above the floor of the cell to define a sludge transport passage beneath it.

3. An electrolytic reduction cell according to claim 1 or 2 in which each baffle member is positioned to remain submerged in molten metal at all stages of the normal cell operating cycle.

4. An electrolytic reduction cell according to claim 1 or 2 in which each baffle member is constructed of material which is resistant to attack by said molten product metal and said molten electrolyte and is more dense than said molten product metal.

5. An electrolytic reduction cell according to claim 1 or 2 in which each baffle member extends into frozen electrolyte at a side wall of the cell from a location within the shadow of an adjacent anode.

* * * * *